US011377997B2

(12) United States Patent
Watanabe

(10) Patent No.: US 11,377,997 B2
(45) Date of Patent: Jul. 5, 2022

(54) COOLING DEVICE FOR POWER SOURCE FOR BOAT PROPULSION APPARATUS

(71) Applicant: SUZUKI MOTOR CORPORATION, Hamamatsu (JP)

(72) Inventor: Toshio Watanabe, Hamamatsu (JP)

(73) Assignee: SUZUKI MOTOR CORPORATION

( * ) Notice: Subject to any disclaimer, the term of this patent is extended or adjusted under 35 U.S.C. 154(b) by 279 days.

(21) Appl. No.: 16/696,236

(22) Filed: Nov. 26, 2019

(65) Prior Publication Data

US 2020/0309015 A1 Oct. 1, 2020

(30) Foreign Application Priority Data

Mar. 28, 2019 (JP) ..... JP2019-063227

(51) Int. Cl.

| | |
|---|---|
| ***F01P 3/20*** | (2006.01) |
| ***B01D 3/00*** | (2006.01) |
| ***F01P 11/12*** | (2006.01) |
| ***B63H 21/38*** | (2006.01) |
| *F01P 3/00* | (2006.01) |

(52) U.S. Cl.

CPC ..... *F01P 3/205* (2013.01); *B63H 21/383* (2013.01); *F01P 11/12* (2013.01); *F01P 2003/001* (2013.01)

(58) Field of Classification Search

CPC . F02B 61/045; B01D 3/00; B01D 2311/2649; F01P 3/202; F01P 11/12

See application file for complete search history.

(56) References Cited

U.S. PATENT DOCUMENTS

| | | | | |
|---|---|---|---|---|
| 8,133,087 | B1 * | 3/2012 | Abou Zeid | B63H 20/28 440/88 L |
| 9,920,680 | B1 * | 3/2018 | George | F01P 11/06 |
| 10,092,863 | B1 * | 10/2018 | George | B63H 20/28 |
| 10,233,818 | B1 * | 3/2019 | Reichardt | F01P 3/205 |
| 2001/0027757 | A1 * | 10/2001 | Katayama | F02B 61/045 123/456 |
| 2003/0040231 | A1 | 2/2003 | Matsuda et al. | |
| 2003/0224671 | A1 * | 12/2003 | Katayama | B63H 20/001 192/85.42 |
| 2009/0318039 | A1 * | 12/2009 | Hays | F01P 11/029 440/88 C |

(Continued)

FOREIGN PATENT DOCUMENTS

| | | |
|---|---|---|
| JP | S61-184198 A | 8/1986 |
| JP | 2003063497 A | 3/2003 |

*Primary Examiner* — Long T Tran

(74) *Attorney, Agent, or Firm* — Barnes & Thornburg LLP

(57) ABSTRACT

A cooling device for a power source for a boat propulsion apparatus includes a cooling water passage. The cooling water passage includes a passage provided in the power source, in which an engine or an electric motor is used as the power source of the boat propulsion apparatus that propels a boat. Water from outside the boat is taken into the cooling water passage as cooling water to cool the power source, and the cooling water after cooling the power source is drained from the cooling water passage. From the cooling water flowing through the cooling water passage, foreign substances having a size that clogs the cooling water passage are removed. The cooling water passage is provided with a filter device which can filter residual foreign substances remaining in the cooling water.

7 Claims, 5 Drawing Sheets

(56) References Cited

U.S. PATENT DOCUMENTS

2012/0091069 A1* 4/2012 Fischmann T. ..... C02F 1/5281
210/758
2012/0156949 A1* 6/2012 Larson ..... F02B 29/0437
123/542

* cited by examiner

COOLING DEVICE FOR POWER SOURCE FOR BOAT PROPULSION APPARATUS

CROSS-REFERENCE TO RELATED APPLICATIONS

This application claims the benefit of priority of Japanese Patent Application No. 2019-063227, filed Mar. 28, 2019, the entire contents of which are incorporated herein by reference.

BACKGROUND OF THE INVENTION

Field of the Invention

The present invention relates to a cooling device for a power source for a boat propulsion apparatus that removes residual foreign substances in cooling water for cooling an engine or an electric motor by filtering the cooling water.

Description of the Related Art

In recent years, pollution by litter (especially microplastic) in the sea, lakes, or rivers has become a serious environmental destruction problem, and some sort of measures for collecting them are desired to be taken. Although the definition of microplastic is not yet fixed, it generally refers to fine plastic particles having a size of 5 mm or less. In general, the smaller the size of litter, the more difficult it is to collect. In particular, microplastics have a great influence on aquatic organisms, and therefore proactive collecting measures are desired to be taken.

To cool the engine or electric motor of the boat propulsion apparatus, generally, outside water is taken into the boat propulsion apparatus as cooling water to cool the heat generation part of the engine or electric motor, and the cooling water after cooling such part is then drained out of the propulsion apparatus. However, the water once taken is simply returned to the water as it is, and the purification point of view (environmental measures) has been overlooked for the cooling water.

A strainer or the like is generally provided at the cooling water intake in the boat propulsion apparatus (see, for example, JP S61-184198 A), and large litter (e.g., a lid of a plastic bottle) are hard to get in the cooling water passage in the boat propulsion apparatus. However, there is a high possibility that fine litter (e.g., litter of about 1 mm) passing through the strainer is sucked into the cooling water passage as it is. While there is a chance of collecting such litter from the water sucked in as the cooling water, the opportunity to capture microplastic, which is particularly difficult to collect, has been missed.

JP 2003-063497 A discloses an example in which a filter is provided in the cooling water passage. However, this filter is provided in order to remove pebbles and algae. In other words, the filter disclosed in JP 2003-063497 A is simply intended to remove foreign substances and is basically the same as the filter provided at the water intake disclosed in JP S61-184198 A.

In the boat propulsion apparatus with a displacement of over 4000 cc and an output of 300 ps, it is possible to flow 100 L (liter) per minute of cooling water, which is 6000 L (corresponding to 30 oil drums) per hour. In the conventional boat propulsion apparatus, as described above, such a large amount of cooling water is drained as it is without collecting litter such as microplastic. Further, when collecting litter in the cooling water, the measure that causes deterioration of the power performance of the boat propulsion apparatus or requires addition of a complicated configuration leads to a decrease in the commercial value of the boat propulsion apparatus and is not a realistic measure.

SUMMARY OF THE INVENTION

The present invention has been made in consideration of the above circumstances, and an object of the present invention is to provide a cooling device for a power source for a boat propulsion apparatus that can collect and effectively remove environmental pollutants such as microplastics existing in water during cruising of the boat.

A cooling device for a power source for a boat propulsion apparatus according to an embodiment of the present invention includes a cooling water passage. The cooling water passage includes a passage provided in the power source, in which an engine or an electric motor is used as the power source of the boat propulsion apparatus that propels a boat. Water from outside the boat is taken into the cooling water passage as cooling water to cool the power source, and the cooling water after cooling the power source is drained from the cooling water passage. From the cooling water flowing through the cooling water passage, foreign substances having a size that clogs the cooling water passage are removed. The cooling water passage is provided with a filter device which can filter residual foreign substances remaining in the cooling water.

According to the present invention, the cooling water passage including the passage provided in the power source of the boat propulsion apparatus is provided with the filter device that can filter the residual foreign substances remaining in the cooling water which flows through the cooling water passage to cool the power source. Hence, the environmental pollutants such as microplastics existing in water can be filtered, collected, and effectively removed by the filter device as the residual foreign substances remaining in the cooling water during cruising of the boat which is propelled by driving the power source.

DETAILED DESCRIPTION

Hereinafter, an embodiment for carrying out the present invention will be described based on the drawings.

Figure 1:
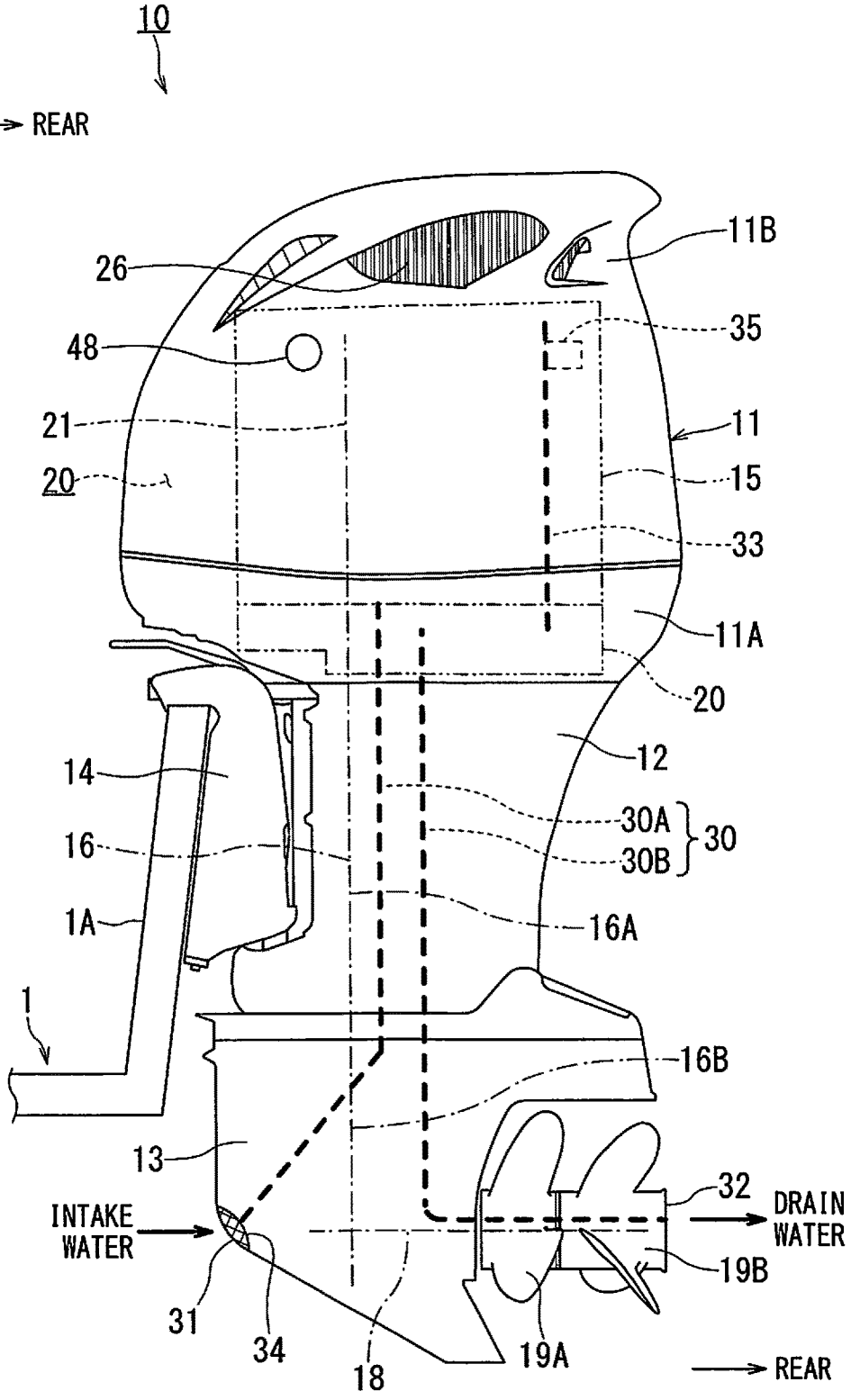
FIG. 1 illustrates a left side view of an outboard motor as a boat propulsion apparatus to which an embodiment of a cooling device of a power source for a boat propulsion apparatus according to the present invention is applied.

FIG. 1 illustrates a left side view of an outboard motor as a boat propulsion apparatus to which an embodiment of a cooling device of a power source for a boat propulsion apparatus according to the present invention is applied. An outboard motor 10 shown in FIG. 1 as the boat propulsion apparatus includes an engine cover 11, a drive shaft housing 12 provided below the engine cover 11, and a gear case 13 provided below the drive shaft housing 12. The outboard motor 10 is attached to the transom 1A of the boat 1 using a bracket device 14 disposed at the front of the outboard motor 10.

Figure 2:
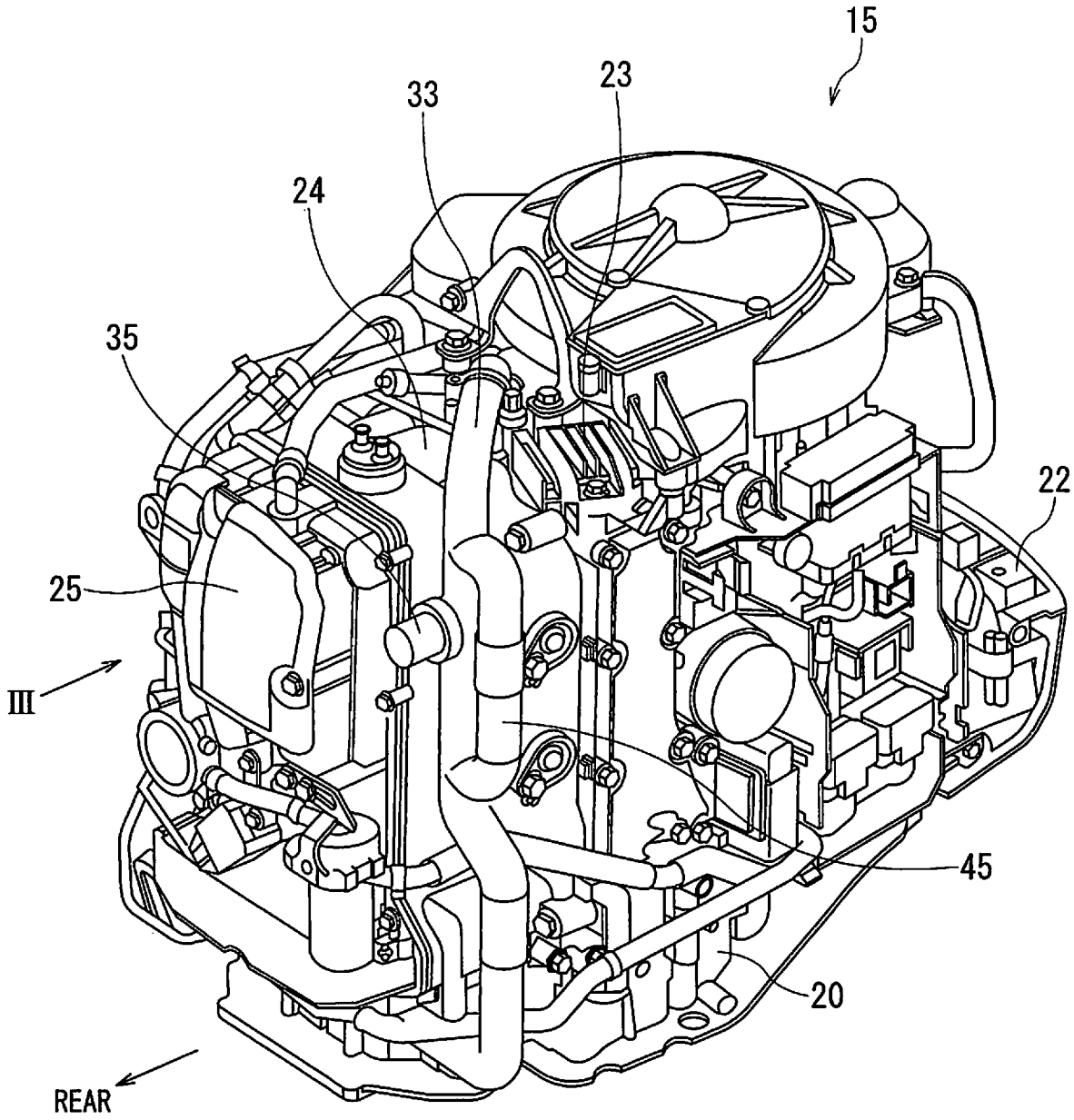
FIG. 2 is a perspective view showing an engine or the like as the power source mounted in the outboard motor shown in FIG. 1.

The drive system of the outboard motor 10 includes an engine 15 that is an internal combustion engine, a drive shaft 16, a propeller shaft 18, and propulsion propellers 19A and 19B. The engine 15 is the power source of the outboard motor 10, is mounted on an engine holder 20, and is housed in the engine cover 11 together with the engine holder 20. The engine 15 is a water-cooled engine and is arranged so that the axial direction of a crankshaft 21 is up and down. As shown in FIG. 2, in the engine 15 a crankcase 22, a cylinder block 23, a cylinder head 24, and a head cover 25 are sequentially arranged from the front side to the rear side of the outboard motor.

The drive shaft 16 shown in FIG. 1 is disposed in the drive shaft housing 12 so as to extend in the vertical direction, and the rotational power of the engine 15 is transmitted to the drive shaft 16. The drive shaft 16 includes a first drive shaft 16A and a second drive shaft 16B. A shift mechanism (not shown) is arranged between the first drive shaft 16A and the second drive shaft 16B, and the shift mechanism performs connecting and disconnecting of the transmission of rotation power and performs switching of the rotation direction.

The propeller shaft 18 is disposed in the gear case 13 so as to extend in the front-rear direction, and transmits the rotational power of the engine 15 transmitted to the drive shaft 16 to the propulsion propellers 19A and 19B. The propulsion propellers 19A and 19B form a counter-rotating propeller.

The engine cover 11 includes an under cover 11A and an upper cover 11B that is detachably attached to the upper portion of the under cover 11A. The under cover 11A covers the lower part of the engine 15 and the engine holder 20, and the upper cover 11B covers the upper part of the engine 15. The combustion air intakes 26 are opened on the left and right sides of the upper cover 11B.

The engine 15 is water-cooled type as described above, and the outboard motor 10 is provided with a cooling water passage 30 including a water jacket (not shown) of the engine 15. The cooling water passage 30 includes a supply side passage 30A for supplying the cooling water to the water jacket of the engine 15 and a drain side passage 30B for guiding the cooling water after cooling the engine 15.

The most upstream side of the supply side passage 30A is a water intake port 31 opened at the front end of the gear case 13. The most downstream side of the drain side passage 30B is a drain port 32 formed in the hub of the propulsion propeller 19B. The supply side passage 30A is formed inside the gear case 13, the drive shaft housing 12, and the engine holder 20, and supplies water to the engine 15. The drain side passage 30B includes a drainage pipe 33 that connects the cylinder block 23 of the engine 15 and the engine holder 20, and is formed inside the engine holder 20, the drive shaft housing 12, and the gear case 13.

Water outside the boat 1 and the outboard motor 10 is taken into the supply side passage 30A as the cooling water from the water intake port 31. The cooling water flows through the supply side passage 30A and reaches the water jacket of the engine 15 by the operation of a water pump (not shown) driven by the drive shaft 16, and cools the combustion chamber and exhaust passage (both not shown) of the engine 15 and the like. The cooling water after cooling the engine 15 flows through the drain side passage 30B including the drainage pipe 33 and is drained from the drain port 32 to the outside of the outboard motor 10.

The water intake port 31 of the supply side passage 30A is provided with a strainer 34 that captures foreign substances having a size that may cause clogging of the cooling water passage 30, such as pebbles and algae. Alternatively, when the strainer 34 is not positioned in the water intake port 31, the water intake port 31 itself is formed in the porous structure having many holes of small diameters. The cooling water flowing in the cooling water passage 30 is the cooling water from which foreign substances having a size that cause clogging of the cooling water passage 30 are removed by the strainer 34.

Further, the cooling water passage 30 (supply side passage 30A and drain side passage 30B) is provided with a filter device 35 that can filter and collect residual foreign substances remaining in the cooling water flowing in the cooling water passage 30, especially environmental pollutants such as microplastics. Here, the microplastics refers to fine plastic particles, generally having a size of 5 mm or less, diffused in an environment such as the ocean. In the present embodiment, the lower limit of the size of the remaining foreign substances captured and collected by the filter device 35 is close to the lower limit of the size visually observable with the naked eye, for example, about 0.1 to 0.2 mm.

As described above, the filter device 35 is disposed in the cooling water passage 30, whereby the environmental pollutants such as microplastics existing in water can be captured and collected by the filter device 35 and hence effectively removed during the operation of the outboard motor 10 that drives the engine 15, that is, during cruising of the boat 1.

Further, a large amount of cooling water can flow through the outboard motor 10 having a large amount of drainage and a high output. For example, in the outboard motor 10 with a displacement of over 4000 cc and an output of 300 ps, it is possible to flow a cooling water of 100 L per minute, which is cooling water of 6000 L (corresponding to 30 oil drums) per hour. This makes it possible to remove a large amount of marine pollutants (such as microplastics) in the cooling water in one voyage.

In addition, by cruising around the fish cages with boat 1 provided with the outboard motor 10, fish farmers who use the cages can effectively capture the rest of the baits and the like as well as the microplastics by the filter device 35 installed in the outboard motor 10, and thus can proactively contribute to the prevention of marine pollution.

The filter device 35 described above may be provided in either the supply side passage 30A or the drain side passage 30B of the cooling water passage 30. The present embodiment shows an example in which the filter device 35 is disposed in the drain side passage 30B that guides the cooling water after cooling the engine 15 to the drain port 32, particularly disposed in the middle of the drainage pipe 33. As shown in FIGS. 1 and 2, the drainage pipe 33 is disposed on the side of the cylinder head 24 of the engine 15, so that the filter device 35 disposed in the drainage pipe 33 is provided in the upper cover 11B of the engine cover 11. Accordingly, the filter device 35 is easily maintained by removing the upper cover 11B from the under cover 11A.

In addition, the filter device 35 is disposed in the middle of the drain side passage 30B (drainage pipe 33) of the cooling water passage 30 to efficiently capture and collect residual foreign substances (environmental pollutants such as microplastics) in the cooling water. The cooling water flowing through the drain side passage 30B is heated to a high temperature when the engine 15 is warmed up, and the viscosity is lower than that of the cooling water in the cold state before cooling the engine 15. Thus, the cooling water containing residual foreign substances such as microplastics easily flows with low passage resistance in the filter device 35, and the residual foreign substances can be efficiently captured by the filter device 35.

Moreover, by filtering the cooling water in the drain side passage 30B with the filter device 35, it is possible to capture and collect the litter remaining in the engine 15. Thus, environmental pollutants can be removed without affecting the power performance of the engine 15 by filtering the cooling water after cooling the engine 15 with the filter device 35, and the commercial value of the outboard motor 10 can be increased.

Figure 5A:
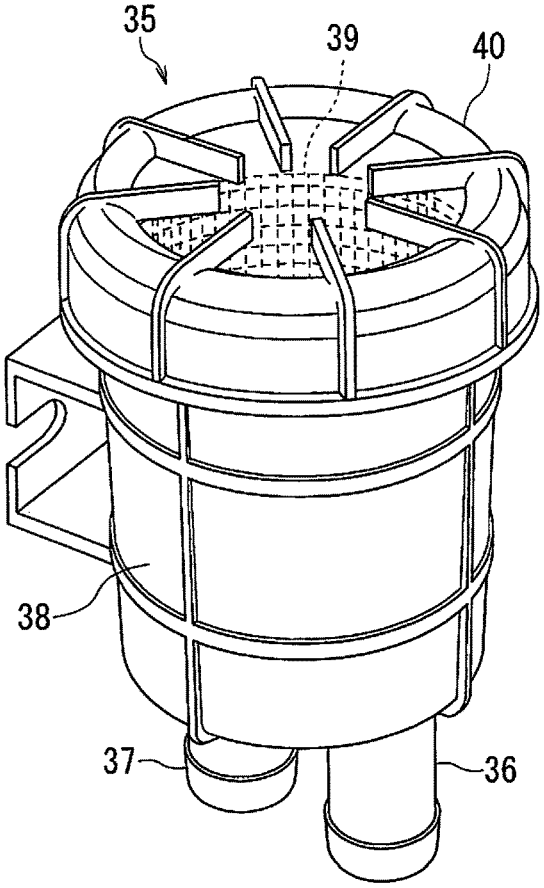
FIG. 5A is a perspective view showing an example of a filter device shown in FIGS. 2 and 3.
Figure 5B:
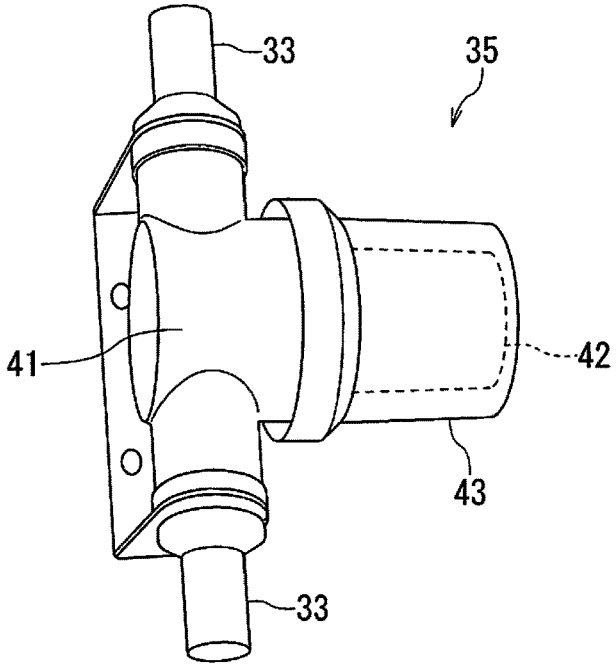
FIG. 5B is a perspective view showing another example of a filter device shown in FIGS. 2 and 3.

The above-described filter device 35 is a detachable cartridge type filter device as shown in FIGS. 5A and 5B. As shown in FIG. 5A, the filter device 35 may be a basket type filter device in which the filter device 35 includes a lattice-shaped basket body 39 detachably attached to and accommodated in a container 38. The container has an inflow pipe 36 and an outflow pipe 37 both connected to the drainage pipe 33, and the opening of the container 38 is closed by a transparent lid 40 screwed to the container 38. In this case, the basket body 39 captures residual foreign substances such as microplastics in the cooling water. When the basket body 39 is clogged with residual foreign substances, the basket body 39 is detached from the container 38 and the captured residual foreign substances are removed therefrom, and then the basket body 39 is reattached to the container 38.

Alternatively, as shown in FIG. 5B, the filter device 35 may be a cassette type filter device in which the filter device includes a capsule-like filter 42 detachably attached to a main body 41 and the filter 42 is covered with a transparent cap 43 that is screwed to the main body 41. In this case, the filter 42 captures residual foreign substances such as microplastics in the cooling water. When the filter 42 is clogged with residual foreign substances, the filter 42 is replaced with a new one. Anyone can easily maintain the filter device 35 by using the cartridge type filter device 35 as described above.

Figure 3:
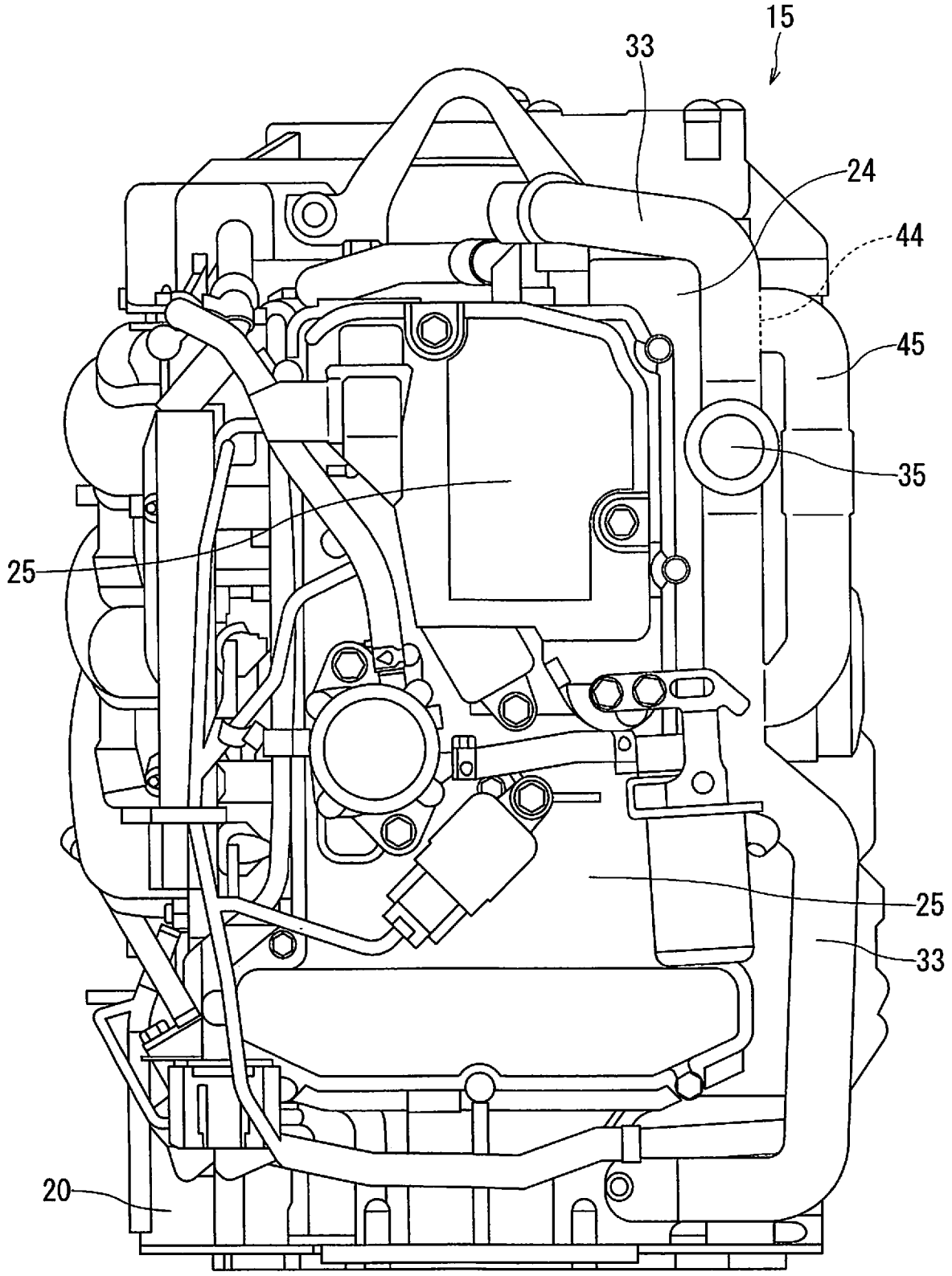
FIG. 3 is a diagram viewing from the direction of an arrow III in FIG. 2.

As shown in FIGS. 2 and 3, the drainage pipe 33 of the drain side passage 30B is connected to a bypass passage 45 for flowing cooling water to bypass the filter device 35 when the filter device 35 is clogged. A relief valve 44 is disposed at a connection portion between the upstream end of the bypass passage 45 and the drainage pipe 33.

The relief valve 44 is closed when the filter device 35 is not clogged to guide the cooling water flowing through the drainage pipe 33 to the filter device 35. The relief valve 44 opens when the filter device 35 is clogged to guide the cooling water flowing through the drainage pipe 33 to the bypass passage 45 so as to bypass the filter device 35. Thereby, even when clogging occurs in the filter device 35 and the clogging is not eliminated, it is possible to prevent the cooling performance of the engine 15 from being deteriorated.

The occurrence of the above-mentioned clogging of the filter device 35 is detected by, for example, a pressure sensor installed near the upstream side of the filter device 35 in the drainage pipe 33. On the basis of the detected value of the pressure sensor, the clogging of the filter device 35 is notified to the user of the outboard motor 10 in a recognizable manner by at least one of a warning display 47 (see FIG. 4) and a warning display 48 (see FIG. 1). The warning display 47 may be provided on a display window 46A of the operation panel 46 provided at a position visible from the driver's seat of the boat 1, and a warning display 48 may be provided on the upper cover 11B of the outboard motor 10. The clogging of the filter device 35 may be notified to the user of the outboard motor 10 in a recognizable manner by an alarm from a buzzer or voice or the like.

Figure 4:
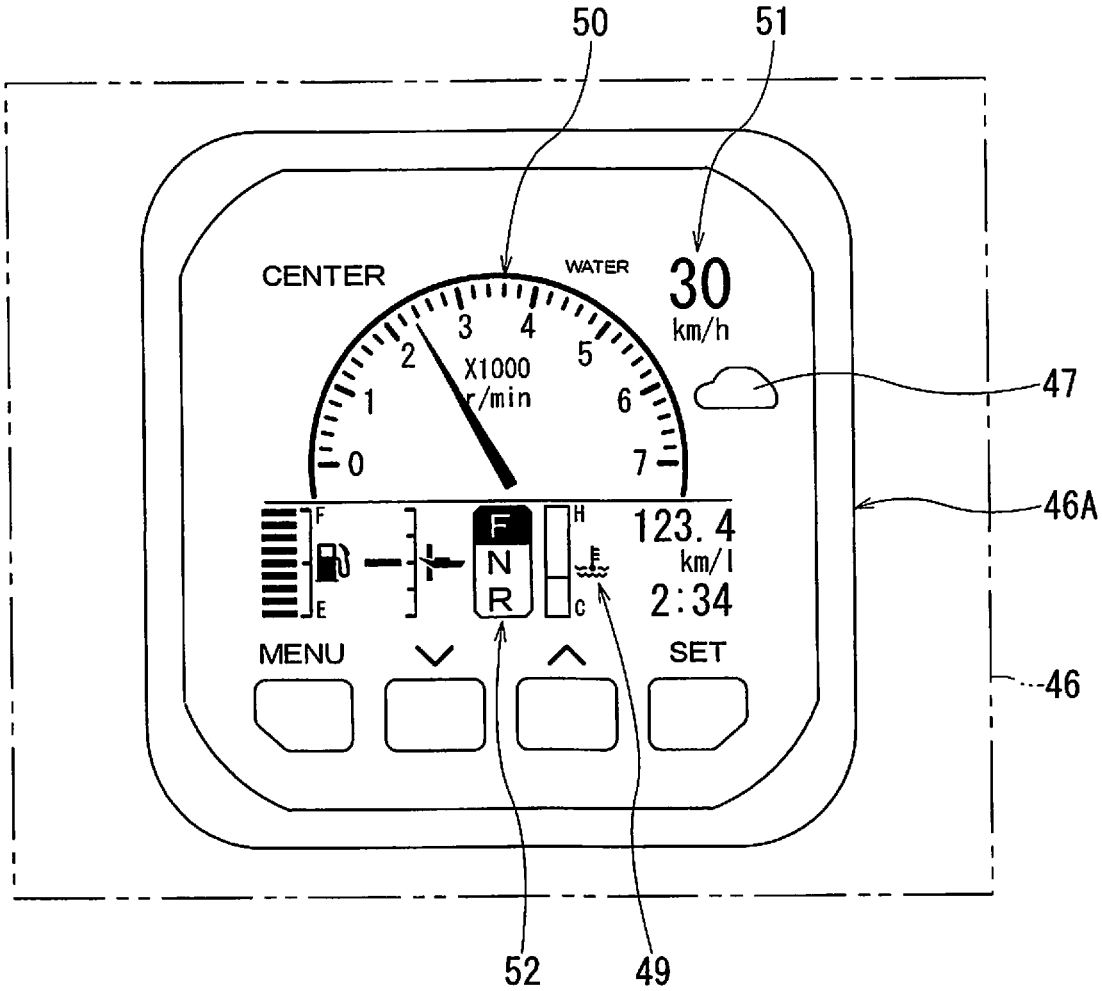
FIG. 4 illustrates a front view showing a display window of an operation panel provided at a position visible from the driver's seat of the boat shown in FIG. 1.

Further, in order to prevent overheating of the engine 15 due to clogging of the filter device 35, it is also effective to notify the user of the outboard motor 10 of a temperature alarm of the engine 15, although not shown. In FIG. 4, reference numeral 49 indicates a temperature display of the cooling water flowing through the engine 15, reference numeral 50 indicates an engine speed display, reference numeral 51 indicates a boat propulsion speed display, and reference numeral 52 indicates a shift display which shows state of the outboard motor 10 such as forward or reverse.

The above-mentioned embodiments are presented as examples only, but not intended to limit the scope of the inventions. The embodiments described herein may be embodied in various forms, and furthermore, omissions, substitutions and changes of the present embodiments may be made without departing from the spirit of the inventions. The accompanying claims and their equivalents are intended to cover such modifications as would fall within the scope of the inventions.

For example, the outboard motor 10 may be driven by a water-cooled electric motor, and the filter device 35 may collect and remove residual foreign substances (environmental pollutants such as microplastics) in the cooling water for cooling the electric motor. In addition, the boat propulsion apparatus is not limited to the outboard motor 10 and includes any power source which propels the boat and requires cooling.

The invention claimed is:

1. A cooling device for a power source for a boat propulsion apparatus, comprising:

a cooling water passage including a passage provided in the power source, an engine or an electric motor being used as the power source of the boat propulsion apparatus that propels a boat, wherein a water from outside the boat is taken into the cooling water passage as cooling water to cool the power source, and the cooling water after cooling the power source is drained from the cooling water passage, the cooling water flowing through the cooling water passage is cooling water from which foreign substances having a size that clogs the cooling water passage are removed, and the cooling water passage is provided with a filter device capable of filtering and collecting residual foreign substances remaining in the cooling water, wherein the filter device is provided downstream of the power source in a drain side passage of the cooling water passage, the drain side passage including a passage through which the cooling water passes from cooling the power source to reaching a drain port.

2. The cooling device for the power source for the boat propulsion apparatus according to claim 1, further comprising a bypass passage provided in the cooling water passage to flow the cooling water to bypass the filter device when the filter device is clogged.

3. The cooling device for the power source for the boat propulsion apparatus according to claim 1, wherein whether the filter device is clogged is recognizable by a user by alarms, voice, or display of an operation panel of the boat, or display provided on a surface of the boat propulsion apparatus.

4. The cooling device for the power source for the boat propulsion apparatus according to claim 1, wherein the filter device is a detachable cartridge type.

5. The cooling device for the power source for the boat propulsion apparatus according to claim 1, wherein the filter device has a filtration function capable of capturing the residual foreign substances having a size of visible to naked eyes.

6. The cooling device for the power source for the boat propulsion apparatus according to claim 1, wherein:

the boat propulsion apparatus is an outboard motor;

the power source of the outboard motor is the engine; and the filter device is arranged in an engine cover of the engine.

7. A cooling device for a power source for a boat propulsion apparatus, comprising:

a cooling water passage including a passage provided in the power source, an engine or an electric motor being used as the power source of the boat propulsion apparatus that propels a boat, wherein a water from outside the boat is taken into the cooling water passage as cooling water to cool the power source, and the cooling water after cooling the power source is drained from the cooling water passage, the cooling water flowing through the cooling water passage is cooling water from which foreign substances having a size that clogs the cooling water passage are removed, the cooling water passage is provided with a filter device capable of filtering residual foreign substances remaining in the cooling water, the boat propulsion apparatus is an outboard motor, the power source of the outboard motor is the engine, and the filter device is arranged in an upper cover of an engine cover of the engine.

* * * * *